US009394695B1

(12) United States Patent
LeClare et al.

(10) Patent No.: US 9,394,695 B1
(45) Date of Patent: Jul. 19, 2016

(54) ADJUSTABLE BRACKET DEVICE FOR SELECTIVELY MOUNTING RAIN GUTTERS ON BUILDINGS

(75) Inventors: Robert Donald LeClare, Asheville, NC (US); Adam Ardery Demchak, Black Mountain, NC (US); Stacy Dewayne Cagle, Canton, NC (US); William Cecil Webb, Fletcher, NC (US); Matthew Wayne Siddall, Weaverville, NC (US); Christopher Kelly McCoy, Candler, NC (US)

(73) Assignee: OMG Roofing, Inc., Agawam, MA (US)

( * ) Notice: Subject to any disclaimer, the term of this patent is extended or adjusted under 35 U.S.C. 154(b) by 459 days.

(21) Appl. No.: 13/548,672

(22) Filed: Jul. 13, 2012

(51) Int. Cl.
*E04D 13/072* (2006.01)
*A47H 1/144* (2006.01)

(52) U.S. Cl.
CPC ..... *E04D 13/0725* (2013.01); *A47H 1/144* (2013.01)

(58) Field of Classification Search
CPC ..... E04D 13/0725; H01M 2/14; A47H 1/144
USPC ..... 52/11, 12, 13, 15; 248/48.1, 48.2
See application file for complete search history.

(56) References Cited

U.S. PATENT DOCUMENTS

| | | | | |
|---|---|---|---|---|
| 3,426,987 | A | 2/1969 | Leslie | |
| 3,752,428 | A * | 8/1973 | Trostle et al. | 248/48.2 |
| 4,120,474 | A * | 10/1978 | Hurley | 248/263 |
| 4,179,091 | A * | 12/1979 | Bidney | 248/265 |
| 5,570,860 | A | 11/1996 | Schoenherr | |
| 5,617,678 | A | 4/1997 | Morandin et al. | |
| 5,779,206 | A * | 7/1998 | Harris et al. | 248/214 |
| 5,845,435 | A * | 12/1998 | Knudson | 52/11 |
| 6,168,125 | B1 * | 1/2001 | Winger et al. | 248/228.3 |
| 6,701,674 | B1 | 3/2004 | Albracht | |
| 6,726,155 | B1 * | 4/2004 | Zimmerman | 248/48.1 |
| D568,727 | S * | 5/2008 | Walker et al. | D8/380 |
| 7,488,018 | B2 | 2/2009 | Rommelmann, Jr. | |
| 7,624,541 | B2 * | 12/2009 | Gentry | 52/12 |
| 7,752,812 | B2 | 7/2010 | Knudson et al. | |
| 7,891,141 | B2 | 2/2011 | Kennedy | |
| 2002/0073631 | A1 * | 6/2002 | Baker | 52/12 |
| 2004/0000098 | A1 | 1/2004 | Knudson | |
| 2008/0029654 | A1 | 2/2008 | Iannelli | |
| 2009/0255190 | A1 * | 10/2009 | Kennedy | 52/11 |

FOREIGN PATENT DOCUMENTS

| | | |
|---|---|---|
| JP | 6257261 A | 9/1994 |

* cited by examiner

*Primary Examiner* — Joshua J Michener
*Assistant Examiner* — Alp Akbasli
(74) *Attorney, Agent, or Firm* — Alix, Yale & Ristas, LLP

(57) ABSTRACT

An adjustable bracket device for selectively mounting on buildings a plurality of rain gutters of different sizes and shapes, includes a base having an elongate mounting member and an integral arm member projecting outwardly therefrom. An extension member is attachable to the arm member in multiple overlapping relationships forming the assembled arm and extension members of differing collective lengths. The base is disposed within a selected gutter in a substantially vertical orientation with the mounting member abutted against the back wall of the gutter and is secured to a vertical building wall via a fastener penetrated through mounting member and through the back wall of the gutter. The collective overlapping length of the arm and extension members is selected to conform to the width of the selected gutter to extend laterally across the full channel width of the gutter into supporting engagement with the front wall of the gutter.

6 Claims, 6 Drawing Sheets

ADJUSTABLE BRACKET DEVICE FOR SELECTIVELY MOUNTING RAIN GUTTERS ON BUILDINGS

FIELD OF THE INVENTION

The present invention relates generally to building construction and, more particularly, to the installation of rain gutters on buildings.

BACKGROUND OF THE INVENTION

Architects and engineers typically give careful attention in the design of buildings, particularly commercial buildings, to the ability of the structure to safely withstand major wind events. However, little attention may be given to the wind resistance of certain non-structural exterior building components, such as rain gutters. Rain gutter mounting systems, typically a series of hanger brackets which support a gutter along a roof perimeter, are generally well designed to resist the expected gravitational loads imposed by rainwater runoff into the gutters but can be highly subject to wind forces acting underneath the gutter system which can tend to uplift the gutter from the building and can, in turn, result in progressive lifting and peeling of the adjacent roof and building facia components. In the past, there has been little or no industry guidelines for wind design of gutters. Recently, however, the American National Standards Institute (ANSI) has promulgated wind testing standards for the performance of commercial building rain gutters during wind events.

SUMMARY OF THE INVENTION

The present invention seeks to provide a novel form of bracket device for mounting rain gutters on buildings to resist wind forces and, in particular, to comply with the new ANSI standards. The present invention further seeks to provide a bracket device that is adjustable so as to be capable of selectively mounting any of a plurality of differently sized rain gutters.

Briefly summarized, the present invention provides a novel adjustable bracket device by which a novel gutter installation may selectively mount on buildings any of a plurality of U-shaped rain gutters having differing channel widths between front and back gutter walls. The bracket device includes a base having an elongate substantially straight mounting member and an arm member rigidly integral with the mounting member and projecting transversely outwardly from intermediately along the elongate extent of the mounting member such that the mounting member has a first leg portion extending to one side of the arm member and a second leg portion extending to the opposite side of the arm member. The bracket device further includes an extension member that is selectively attachable to the arm member of the base in a plurality of respectively varying overlapping relationships to the arm member forming the attached arm and extension members to project outwardly from the mounting member to differing selected collective lengths.

In a gutter installation, the base is configured to be disposed within any selected one of the U-shaped rain gutters in a substantially vertical orientation with the first and second leg portions of the mounting member in face abutment against the back wall of the gutter and to be secured with the back wall of the gutter to a vertical surface of a building, e.g., via a fastener penetrated through one of the leg portions and through the back wall of the gutter into the vertical wall surface. The arm and extension members are attachable in a selected overlapping relationship to have a collective length conforming to the channel width of the selected gutter to extend the extension member laterally across the channel width of the gutter into engagement with the front wall of the gutter.

In a contemplated embodiment, the extension member includes a nose portion at a projecting free end thereof, configured for engagement with the front wall of the gutter. For example, the nose portion of the extension member may include a reverse bend in conformity to a lip on the front wall of the gutter.

One of the arm member and the extension member may include a plurality of projecting keys and the other may include a plurality of keyways mated with the keys for selective assembly of the keys and keyways to permit assembly of the arm and extension members in the described plurality of overlapping relationships. Alternatively, the arm member and the extension member may be adapted to be welded to one another in any of a plurality of overlapping relationships.

It is also contemplated that the mounting member of the base may be formed with embossings for engagement against the back wall of the gutter to resist relative movement therebetween when secured to the vertical surface of the building.

DETAILED DESCRIPTION OF THE PREFERRED EMBODIMENTS

Figure 1:
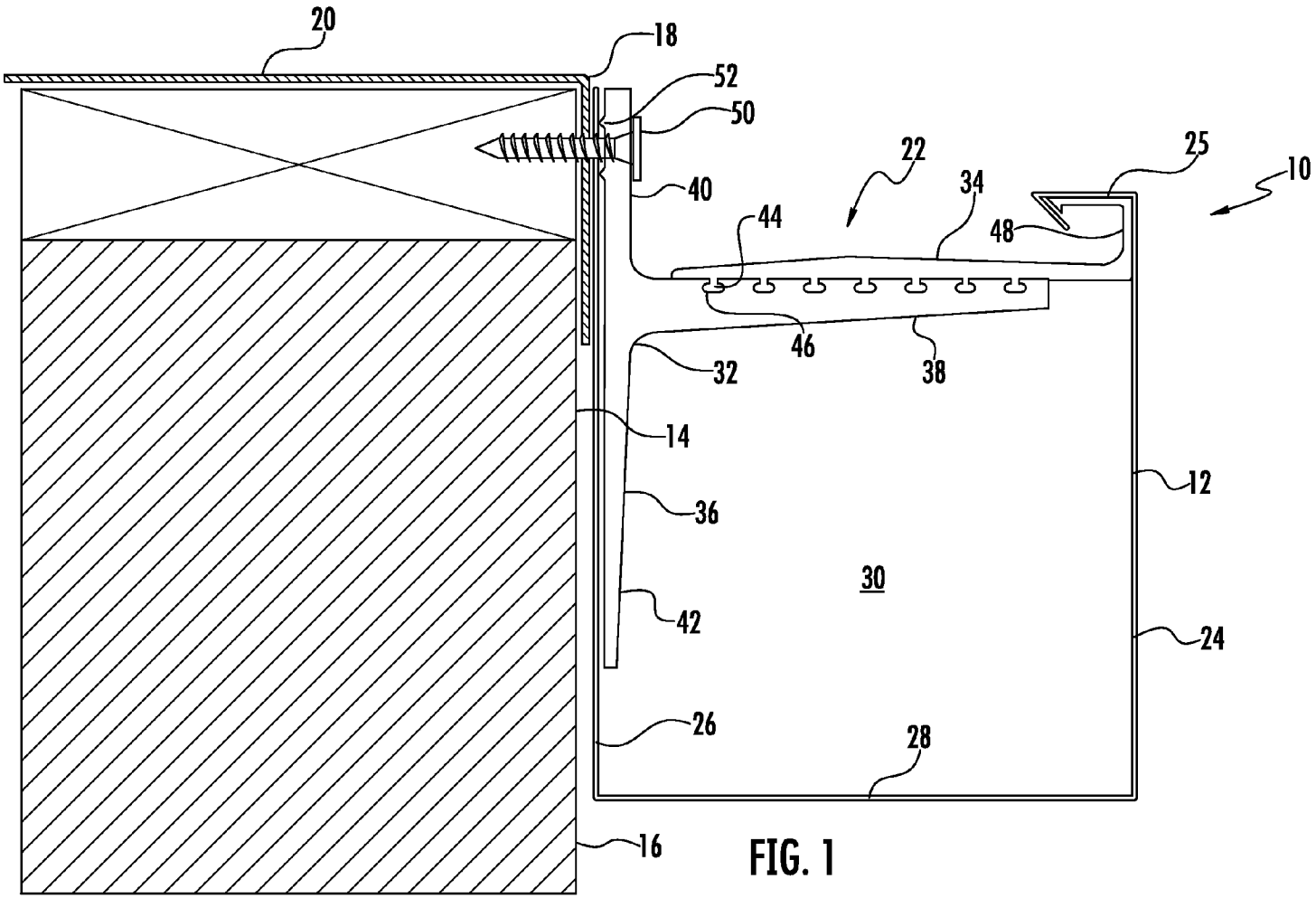
FIG. 1 is a side view, partially in side elevation and partially in vertical cross-section, of a gutter installation using one embodiment of an adjustable bracket device in accordance with the present invention.

Referring now to the accompanying drawings and initially to FIG. 1, a gutter installation is depicted generally at 10 formed of a U-shaped elongate gutter 12 mounted to a vertical wall 14 of a building 16 adjacent a perimeter edge 18 of the building roof 20 by an adjustable bracket device, indicated generally at 22, in accordance with one contemplated embodiment of the present invention. As persons skilled in the relevant art will readily recognize and understand, the building 16, including the roof 20 and the vertical wall 14, are only generically depicted for sake of providing a simplified illustration of a representative gutter installation according to the present invention, but the present invention is not to be construed in any way as limited to use with the depicted form of building structure and, instead, it is to be expressly understood that the present invention may be adapted in the same and various other embodiments for use in substantially any form of building structure to which a rain gutter may be suitable.

The gutter 12 is likewise depicted generically for illustrative purposes to be representative of any of a variety of known forms of U-shaped rain gutters. As persons skilled in the relevant art recognize and understand, substantially all building rain gutters have in common an overall U-shaped cross-section formed by spaced-apart generally upright front and back gutter walls 24, 26 joined at their bottom edges by a connecting bottom wall 28 defining therebetween an interior water flow channel 30 which opens upwardly between the upper edges of the front and back walls 24, 26. Typically, as depicted in FIG. 1, the back gutter wall 26 is substantially flat and planar, while the free upper edge of the front gutter wall 24 is bent to form a front gutter lip 25. Otherwise, however, conventional rain gutters may be of any of various specific cross-sectional profiles and dimensions, particularly in the lateral horizontal widthwise dimension of the channel 30 between the upward ends of the front and back walls 24, 26. As described more fully herein, the adjustable bracket device 22 of the present invention is particularly adapted to enable the bracket device to mount any of a plurality of differing gutters 12 of differing channel widths.

The bracket device 22 basically comprises two components, a base 32 and an extension member 34. The base 32 has a mounting member 36 that is elongate and substantially straight or linear, and an arm member 38 that is rigidly integral with the mounting member 36, projecting transversely outwardly from an intermediate location along the elongate extent of the mounting member 36 such that a first leg portion 40 of the mounting member 36 extends upwardly from one side of the arm member 38 and a second leg portion 42 extends downwardly from the opposite side of the arm member 38.

The arm member 38 and the extension member 34 are compatibly configured to facilitate assembly with one another in any of a plurality of respectively varying overlapping relationships by which the assembled extension and arm members 34, 38 project outwardly from the mounting member 36 to differing collective lengths. As one exemplary embodiment depicted in FIG. 1, the extension member 34 of the base 32 is formed with a series of uniformly spaced-apart keys 44 and the arm member 38 is formed with a mating series of uniformly spaced-apart keyways 46 by which the extension and arm members 34, 38 may be selectively assembled in incrementally varying lengths as desired to shorten or lengthen their overall collective length. The outer free end of the arm member 38 may be formed as a nose portion 48 of any suitable configuration to be compatible with the lip portion 25 of the gutter 12, e.g., in a reversely bent configuration as depicted in FIG. 1.

The installation of a gutter 12 utilizing the adjustable bracket device 22 of the present invention may thus be understood. As is commonplace, the gutter 12 may be formed in elongate lengths which may be connected end-to-end or may be extruded by a suitable forming machine to any desired "seamless" length. For installation of any given lengthwise extent of the gutter 12, a plurality of the bracket devices 22 will be utilized at regular spaced-apart intervals to provide uniform support along the full length of the gutter 12. Each such bracket device 22 is situated within the interior channel 30 of the gutter 12 with the first and second leg portions 40, 42 of the mounting member 36 of the base 32 in a substantially vertical orientation in face abutment against the back wall 26 of the gutter 12. Each base 32 and the back wall 26 of the gutter 12 are mutually affixed to one another and to the vertical wall 14 of the building 16 by a suitable fastener 50, e.g., a threaded mounting screw as depicted in FIG. 1, driven through the first leg portion 40, then through the back wall 26 of the gutter 12 and into the structure of the wall 14 adjacent the roof edge 18. The extension member 34 is assembled in overlapping relationship with the outwardly projecting arm member 38 of the base 32 by selective engagement of its keys 44 into the key ways 46 of the arm member 38 to form the extension and arm members 34, 38 of a collective length to extend laterally across the entire width of the gutter channel 30 and into supporting engagement with the front wall 24 of the gutter 12, e.g., by mating engagement of the nose portion 48 with the gutter lip 25.

Figure 2:
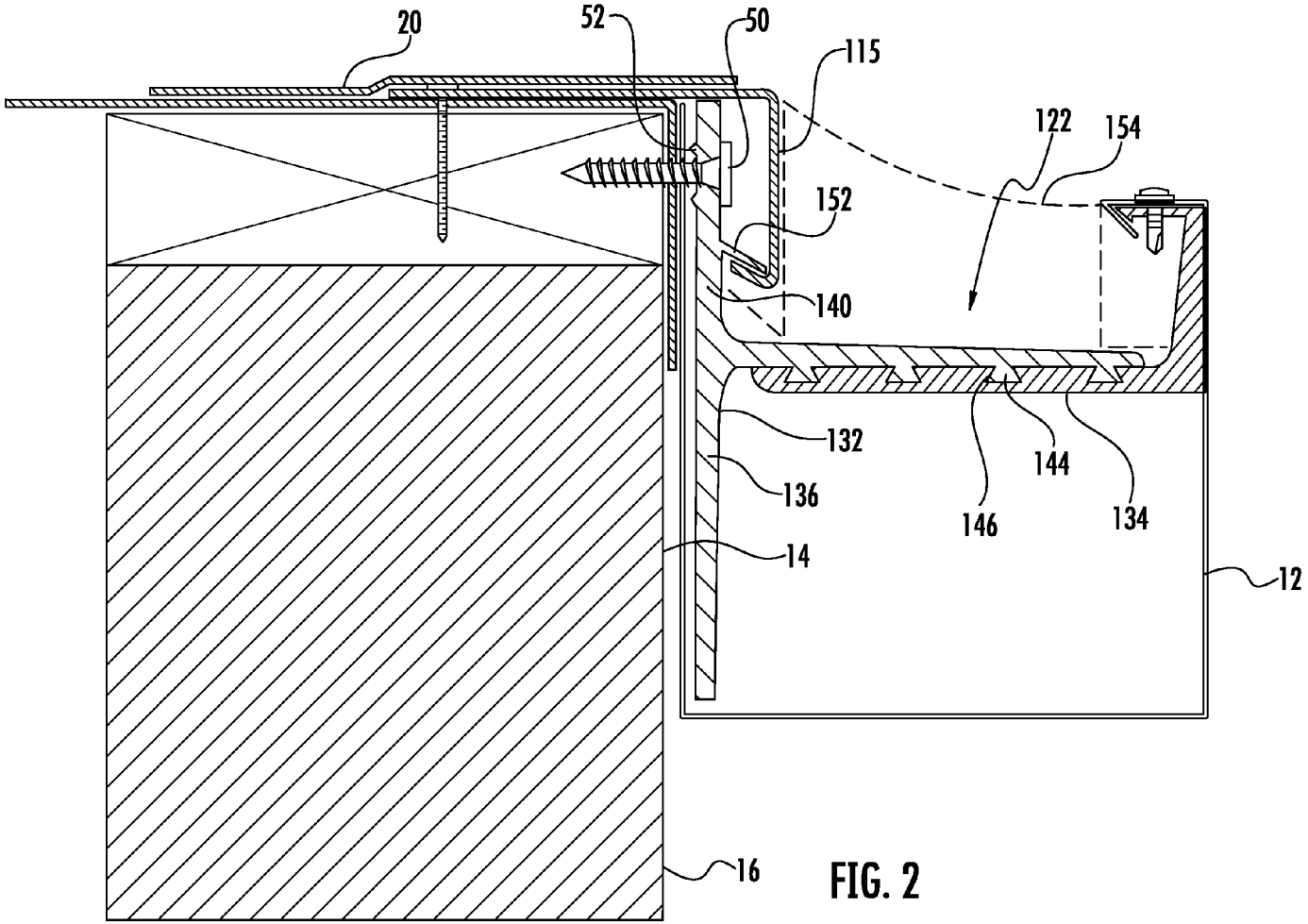
FIG. 2 is another side view similar to FIG. 1, showing a gutter installation using a second embodiment of an adjustable bracket device in accordance with the present invention.
Figure 3:
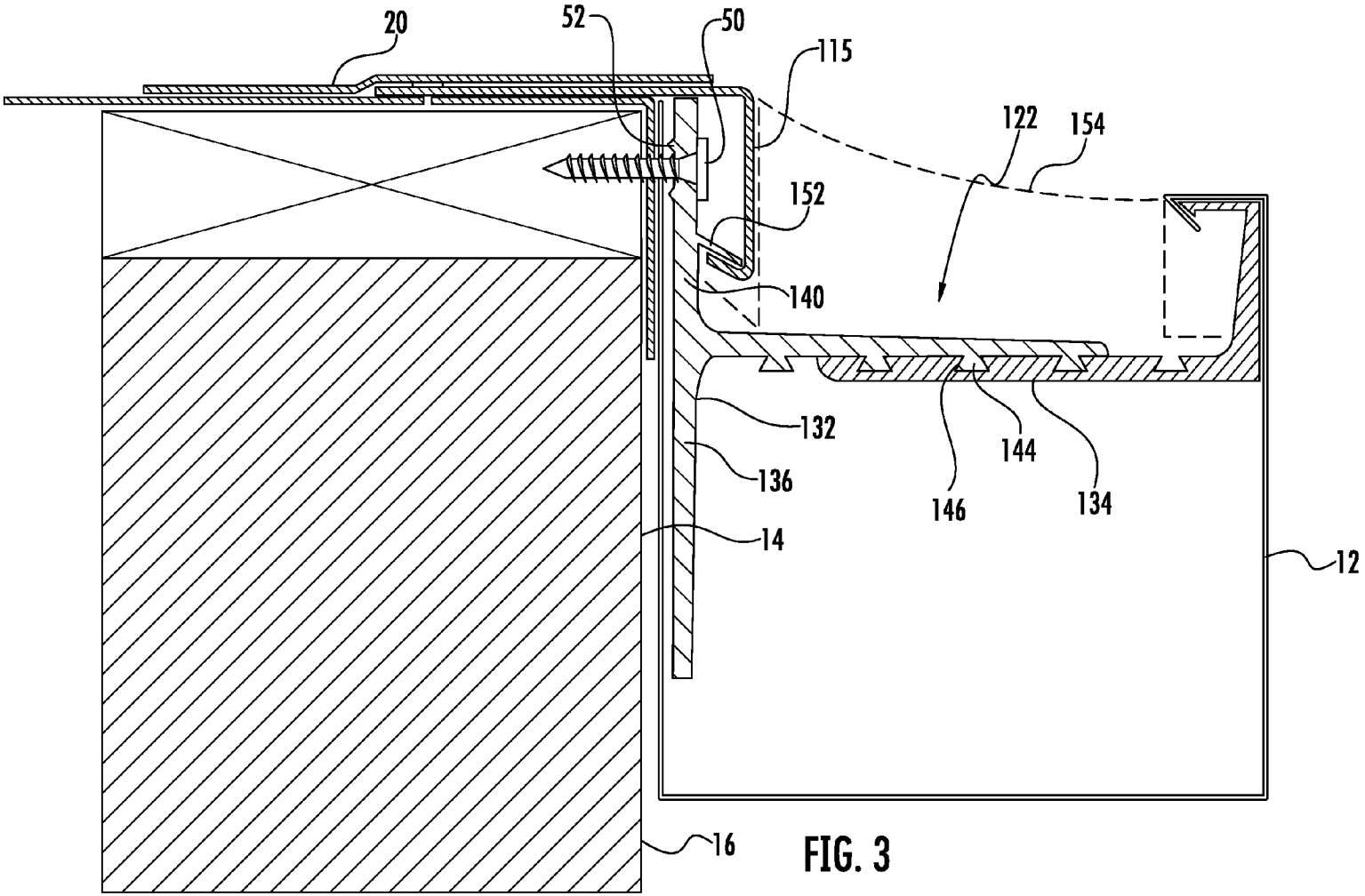
FIG. 3 is a side view similar to FIG. 2, showing the same bracket device thereof but adjustably assembled differently for installation of a differently sized gutter.
Figure 4:
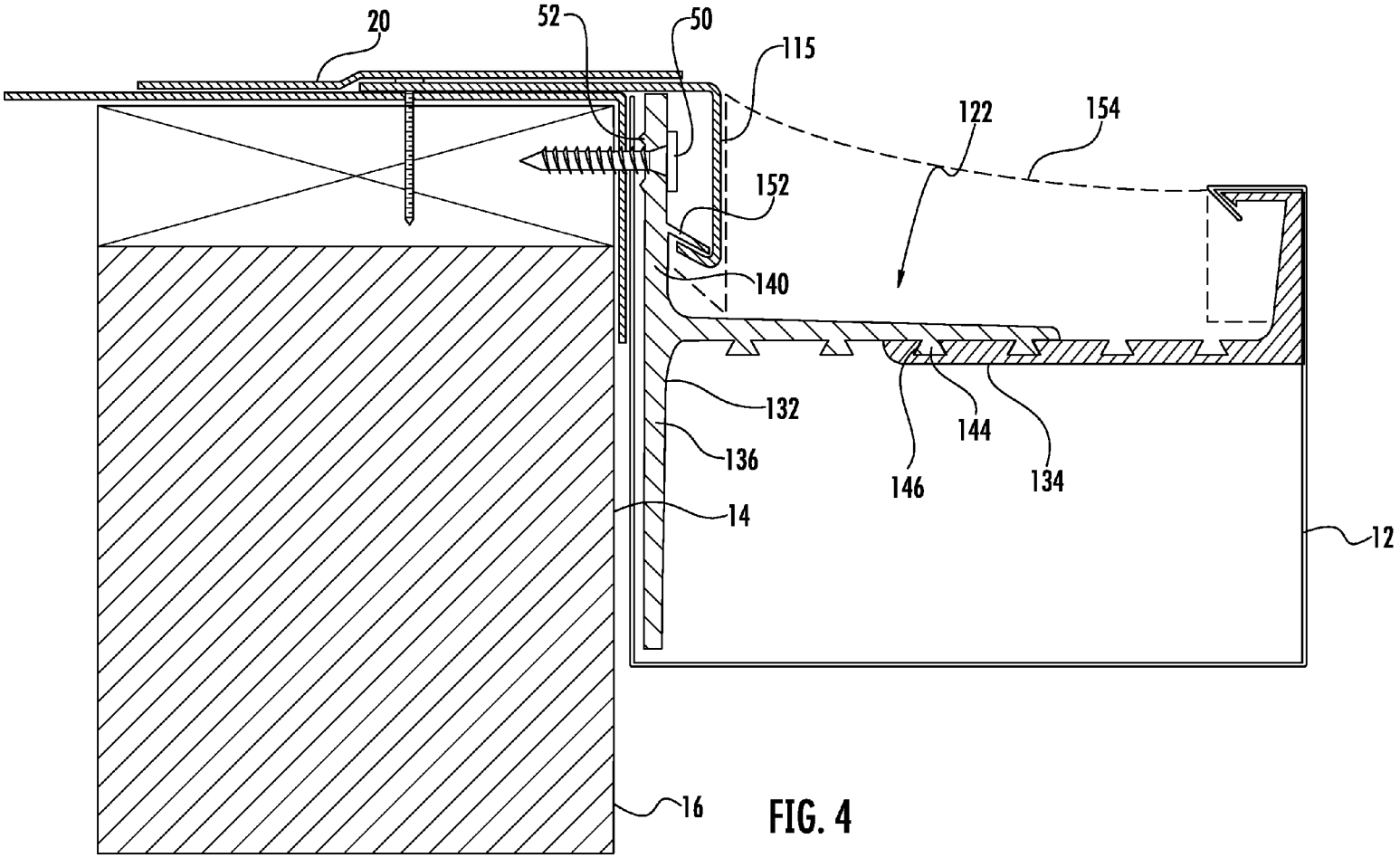
FIG. 4 is a side view similar to FIGS. 2 and 3, showing the same bracket device thereof but adjustably assembled differently for installation of another differently sized gutter.

As will be understood, by selective lengthening or shortening of the collective length of the extension and arm members 34, 38, the bracket device 22 may be adjusted to accommodate the mounting of any of a number of differing gutters 12, including for example an array of the differing sizes of the same cross-sectional gutter profile and/or differently sized gutters of differing cross-sectional profiles. For example, FIGS. 2-4 depict an alternative embodiment of the bracket device, indicated at 122, wherein the extension member 134 and the arm member 138 of the base 132 are assembled in differing overlapping relationships for mounting in FIGS. 2, 3 and 4 three gutters 12 of the same cross-sectional profile but in three different channel sizes, and in FIG. 5 a fourth gutter 12 of a different cross-sectional profile. The embodiment of the bracket device 122 in these Figures differs from that of FIG. 1 in that the arm member 138 of the base 132 is formed with projecting keys 144 and the extension member 34 is formed with mating keyways 146 with the arm member 138 overlapping above the extension member 134 (i.e., the opposite of the embodiment of FIG. 1). Also in this embodiment, the mounting member 136 of the base 132 is formed with a flange 152 projecting from the first leg portion 140 by which a roof drip edge element 115 may be secured in place.

Figure 5:
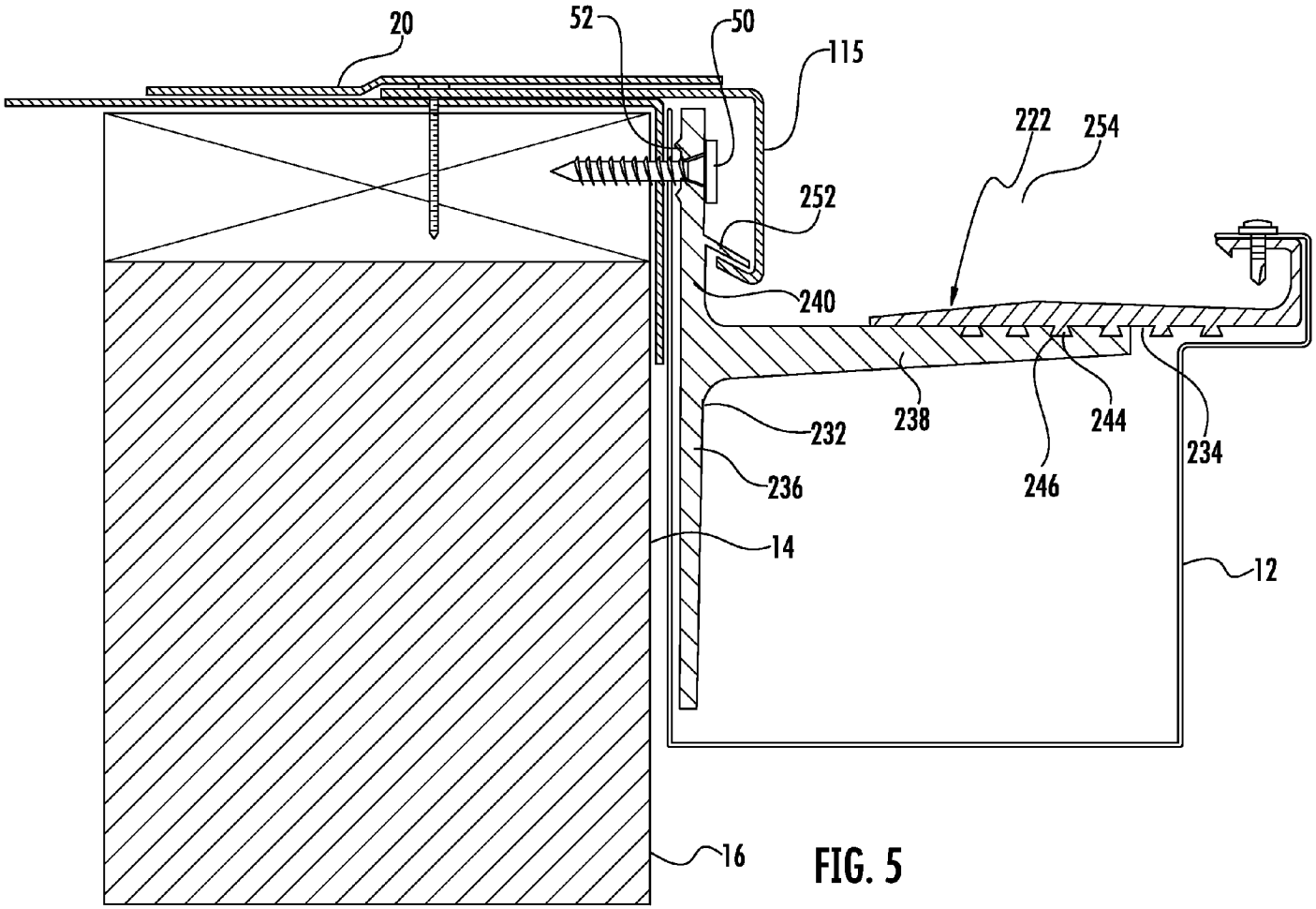
FIG. 5 is a side view similar to FIGS. 1-4, showing a gutter installation using a third embodiment of an adjustable bracket device in accordance with the present invention.

FIG. 5 depict another alternative embodiment of the bracket device, indicated at 222, which is a variant of the embodiments of FIGS. 1-4, wherein the extension member 234 and the arm member 238 of the base 232 are assembled in a selected overlapping relationship for mounting a gutter 12 of a different cross-sectional profile. In the embodiment of the bracket device 222 in this Figure, like that of FIG. 1, the arm member 238 of the base 232 is formed with keyways 246 and the extension member 234 is formed with mating projecting keys 144. Also in this embodiment, the mounting member 236 of the base 232 is formed with a flange 252 projecting from the first leg portion 240 by which a roof drip edge element 115 may be secured in place.

Figure 6:
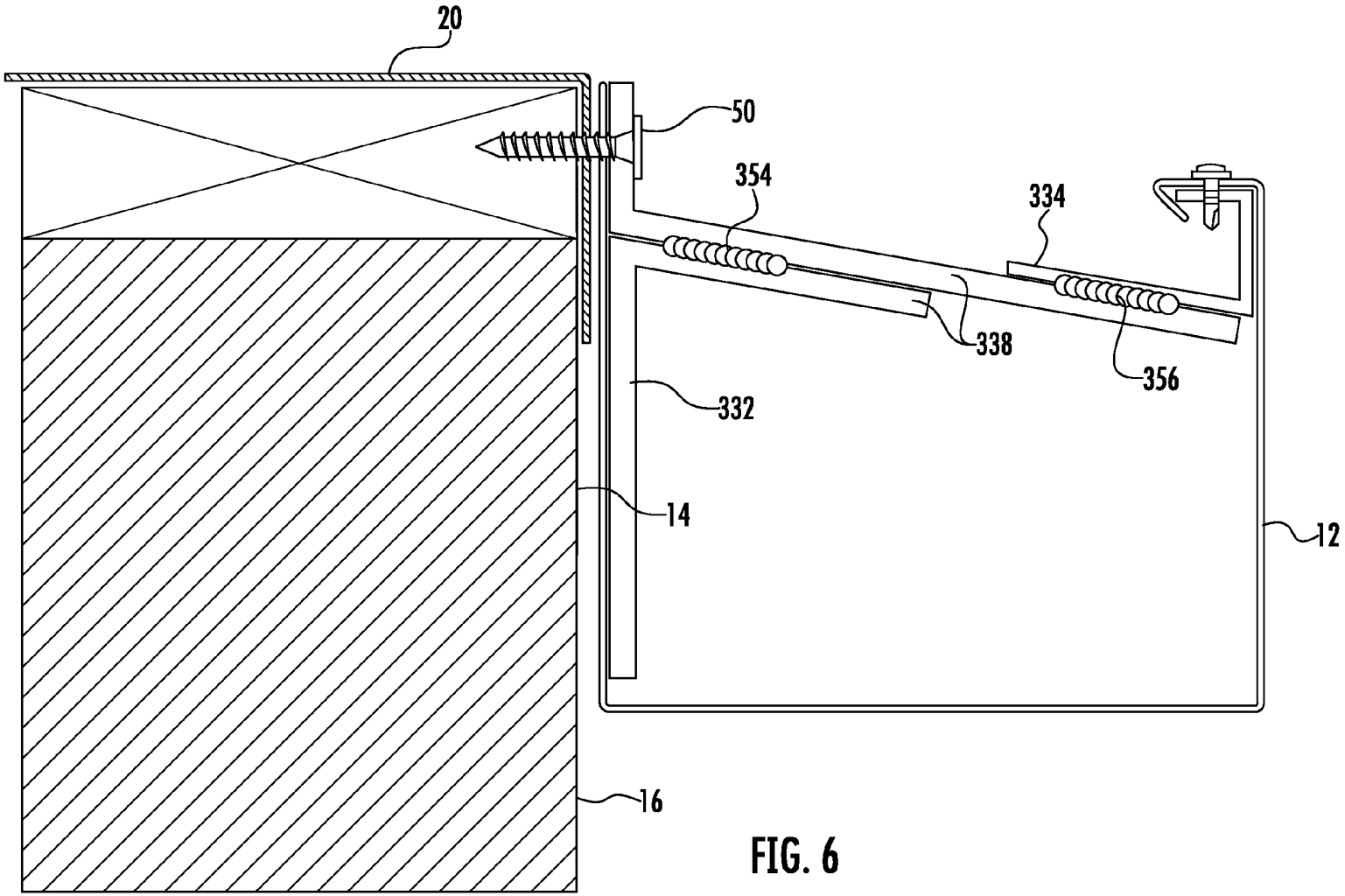
FIG. 6 is another side view similar to FIGS. 1, 2 and 5, showing a gutter installation using a fourth embodiment of an adjustable bracket device in accordance with the present invention.

Of course, it is to be understood that other embodiments of the bracket device of the present invention are also possible. By way of further example, FIG. 6 depicts an embodiment wherein the base 332 is formed of two components welded together at 354 and the extension member 334 is similarly secured in selectively overlapping relationship to the arm member 338 of the base 332 by welds at 356. As may be understood, welded joinder of the components of the bracket device of the present invention may be advantageous or preferred over mating keys and keyways to accommodate finer adjustments in the collective lengthwise dimension of the extension and arm members than can be accomplished incrementally via spaced-apart keys and keyways and also to provide greater collective rigidity in the bracket device.

As will be understood, in operation the bracket device of the present invention is effective via the elongated vertical extent and orientation of the mounting member of the base and its mounted disposition within the channel of the gutter in face abutment to the back gutter wall to act against wind forces directed toward the underside of the gutter to resist uplifting of the gutter from the building wall and, in turn, to prevent or at least mitigate potential damage to the roof components at the adjacent roof edge. To further enhance the securement of the bracket device in place by the fasteners 50, it is also contemplated that the underside of the first leg portion of the base may be formed with a series of teeth or like projections, as represented at 52 in FIGS. 1-5, e.g., formed as embossments in the leg portion, to also resist any tendency of the base 32 to rotate within the gutter channel.

Other enhancements of the bracket device of the present invention are also contemplated. For example, the bracket device may be configured to accommodate the mounting of a leaf screen over the gutter, as representatively depicted in FIG. 3 at 154.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An adjustable bracket device for selectively mounting on buildings a plurality of U-shaped rain gutters having differing channel widths between front and back gutter walls, the bracket device comprising:

a base having an elongate substantially straight mounting member and an arm member rigidly integral with the mounting member and projecting transversely outwardly from intermediately along the elongate extent of the mounting member, the mounting member having a first leg portion extending to one side of the arm member and a second leg portion extending to the opposite side of the arm member, an extension member selectively attachable to the arm member of the base in a plurality of respectively varying overlapping relationships to the arm member comprising a first linear portion which projects transversely outwardly from the mounting member to a transverse terminus to define differing selected collective lengths, said extension member comprising second and third connected linear portions wherein said second linear portion is disposed at a right angle to said first and third linear portions and is generally parallel to said mounting member, and said first and third members are substantially parallel and said second and third linear portions do not extend transversely outwardly from said transverse terminus.

2. An adjustable bracket device for selectively mounting rain gutters on buildings according to claim 1, wherein the extension member includes a nose portion at a projecting free end portion thereof.

3. An adjustable bracket device for selectively mounting rain gutters on buildings according to claim 2, wherein the nose portion of the extension member includes a reverse bend.

4. An adjustable bracket device for selectively mounting rain gutters on buildings according to claim 1, wherein one of the arm member and the extension member includes a plurality of projecting keys and the other of the arm member and the extension member includes a plurality of keyways mated with the keys for selective assembly of the keys and keyways to form the arm and extension members into said plurality of overlapping relationships.

5. An adjustable bracket device for selectively mounting rain gutters on buildings according to claim 1, wherein the arm member and the extension member are adapted to be welded to one another in said plurality of overlapping relationships.

6. An adjustable bracket device for selectively mounting rain gutters on buildings according to claim 1, wherein the mounting member of the base is formed with embossings.

* * * * *